US005593140A

United States Patent [19]

van Beers

[11] Patent Number: 5,593,140

[45] Date of Patent: Jan. 14, 1997

[54] WINCH HAVING A HOUSING WITH A SMOOTH-SURFACED CENTRAL PORTION

[75] Inventor: Willem P. van Beers, Geersdijk, Netherlands

[73] Assignee: Meissner Engineering B.V., Hellevoetsluis, Netherlands

[21] Appl. No.: 270,935

[22] Filed: Jul. 5, 1994

[30] Foreign Application Priority Data

Jul. 5, 1993 [NL] Netherlands ..... 9301178

[51] Int. Cl.[6] ..... B66D 1/00

[52] U.S. Cl. ..... 254/374; 254/266; 242/613.2; 226/193

[58] Field of Search ..... 254/371, 372, 254/266, 374, 344; 242/47.01, 613.2; 226/193

[56] References Cited

U.S. PATENT DOCUMENTS

| | | | |
|---|---|---|---|
| 756,851 | 4/1904 | Hartweg | 254/266 X |
| 1,132,643 | 3/1915 | Whitmore | 242/613.2 X |
| 1,952,181 | 3/1934 | Newill | 242/613.2 X |
| 3,080,014 | 3/1963 | Dahl | 226/193 X |
| 3,288,439 | 11/1966 | Holmes . | |
| 3,302,932 | 2/1967 | Wallin | 254/371 X |
| 4,274,606 | 6/1981 | Bernwall et al. . | |
| 4,688,765 | 8/1987 | Guangorena . | |
| 4,715,583 | 12/1987 | Grützner | 254/372 X |
| 5,397,073 | 3/1995 | Fujimura | 242/613.2 X |

FOREIGN PATENT DOCUMENTS

| | | | |
|---|---|---|---|
| 497574 | 12/1919 | France . | |
| 2213224 | 8/1974 | France . | |
| 2700948 | 7/1978 | Germany | 254/372 |
| 179791 | 6/1962 | Sweden | 254/372 |
| 382351 | 10/1932 | United Kingdom | 242/613.2 |
| 548642 | 10/1942 | United Kingdom . | |
| 2215297 | 9/1989 | United Kingdom . | |
| 84/02511 | 7/1984 | WIPO . | |
| 6710 | 3/1994 | WIPO | 254/371 |

*Primary Examiner*—Katherine Matecki
*Attorney, Agent, or Firm*—Merchant, Gould, Smith, Edell, Welter & Schmidt, P.A.

[57] ABSTRACT

A winch comprising a substantially cylindrical housing, rotatably disposed around a central shaft, which housing comprises, at the top thereof, a flange and has a central portion of a diameter smaller than the diameter of the flange and the diameter of the bottom housing portion, the central portion of the housing having a smooth surface and, in cross section, not being completely circular. To this end, the central portion of the housing is provided with a number of concave faces, for instance six, extending in vertical direction over the central portion, with the possible provision of flat faces between these faces. In the winch according to the invention, it is no longer necessary to roughen the surface of the central portion, which considerably reduces the wear in the sheet to be wound onto the winch.

8 Claims, 6 Drawing Sheets

WINCH HAVING A HOUSING WITH A SMOOTH-SURFACED CENTRAL PORTION

BACKGROUND OF THE INVENTION

The invention relates to a winch comprising a substantially cylindrical housing, rotatably disposed around a central shaft, which housing comprises, at the top thereof, a flange and has a central portion of a diameter smaller than the diameter of the flange and the diameter of the bottom housing portion.

Such a winch, constructed as a self-tailing winch, is disclosed in Dutch patent application 8202198. In a self-tailing winch, the flange becomes thinner toward the circumference and a plate is mounted on the top side of the flange, which plate also becomes thinner toward the circumference and has a diameter equal to that of the flange. Thus, between the flange and the plate a V-shaped groove is present for receiving the line or sheet, directed to a specific shape of the tooth-shaped raised portions which are usually provided on the surfaces, facing each other, of the flange and the plate and which are intended to hold a tight fit on the line or sheet to be wound onto the winch in the V-shaped groove. For this type of winch, as well as for winches of the non-self-tailing type, it is conventional to roughen the outer surface of the central portion of the housing so as to prevent the line or sheet from slipping over the housing surface. The roughness of the surface is in the order of magnitude of 100–150 grains/cm$^2$ and is obtained through a jetting operation with a stainless-steel jetting means. Such slipping of the line has a very adverse effect on the proper functioning of the winch and consequently, experts regard the rough surface of the central portion as strictly necessary. A drawback of the roughened surface, however, is an extra wear of the line portion which is wound around that surface and in particular of the portion which, coming from the sail, first contacts the rough surface. However, this wear has heretofore been considered unavoidable.

SUMMARY OF THE INVENTION

The object of the invention is to provide a winch of the self-tailing type, enabling lines or sheets to be wound up in an extremely reliable manner, while the wear of the line or sheet due to its passing over the central portion of the housing is nevertheless as little as possible.

To this end, the invention provides a self-tailing winch of the above-mentioned type, characterized in that the central portion of the housing has a smooth outer surface comprising a plurality of faces which extend over the central portion in vertical direction and, viewed in horizontal direction along the housing surface, are concave. Preferably, the faces are evenly distributed over the circumference of the central portion of the winch. Alternately flat and concave faces may also be provided. The number of faces is for instance six, eight or ten, but more or fewer faces are possible, as long as the shape of the cross section of the central portion remains sufficiently non-circular.

Surprisingly, it has been found that by virtue of the measures according to the invention, the outer surface of the central portion of the winch housing around which the line or sheet is wound by a number of turns, exhibits sufficient friction to prevent the line or sheet in operation to slip around this central portion, while, in addition, the wear of the line or sheet is reduced to a minimum. Especially nowadays, this reduction in wear is of major importance now that in particular for large yachts and racing ships, lines of a very high price per meter are used. Tests have established that a housing having concave faces provides a considerably greater friction than a round housing or a housing having only flat faces. When the number of faces is equal, causing a sheet to slip over a housing with concave faces requires a pulling force which is at least 50% higher than in the case of a housing with flat faces.

A further advantage of the invention is that there is no longer any friction in vertical direction when the sheet is being unwound; as a result, the efficiency of the winch compared with a winch having a jetted surface is improved.

Another advantage of the invention is that when the metal, often chromed or anodized outer surface of the housing is being polished, it is no longer necessary to realize a neat transition between the polished portion and the roughened portion in the form of a straight line, because the entire outer surface of the housing can now be polished. This is important in particular because experts capable of carrying out the polishing operation for the known winches are rare and hence expensive.

It is observed that U.S. Pat. No. 4,688,765 discloses a winch having a central portion whose cylindrical outer surface comprises recessed, face-shaped portions, the sheet, when it lies around the housing of the winch, being stretched along the edges of the actual outer surface, which edges project between the recessed portions. This construction has as a drawback that a substantial wear of the sheet occurs along these edges, due to the abrupt transition between each edge and the adjoining recessed portion. In the winch according to the invention, the transition between adjoining concave and/or flat faces along the surface of the housing and the intermediate face portions of the original housing is much more even, so that less wear occurs while the sheet does not slip all the same and can readily move in vertical direction along the housing.

BRIEF DESCRIPTION OF THE DRAWINGS

The invention will be further explained hereinafter on the basis of exemplary embodiments with reference to the accompanying drawings. In these drawings.

DETAILED DESCRIPTION OF THE PREFERRED EMBODIMENT

Figure 1:
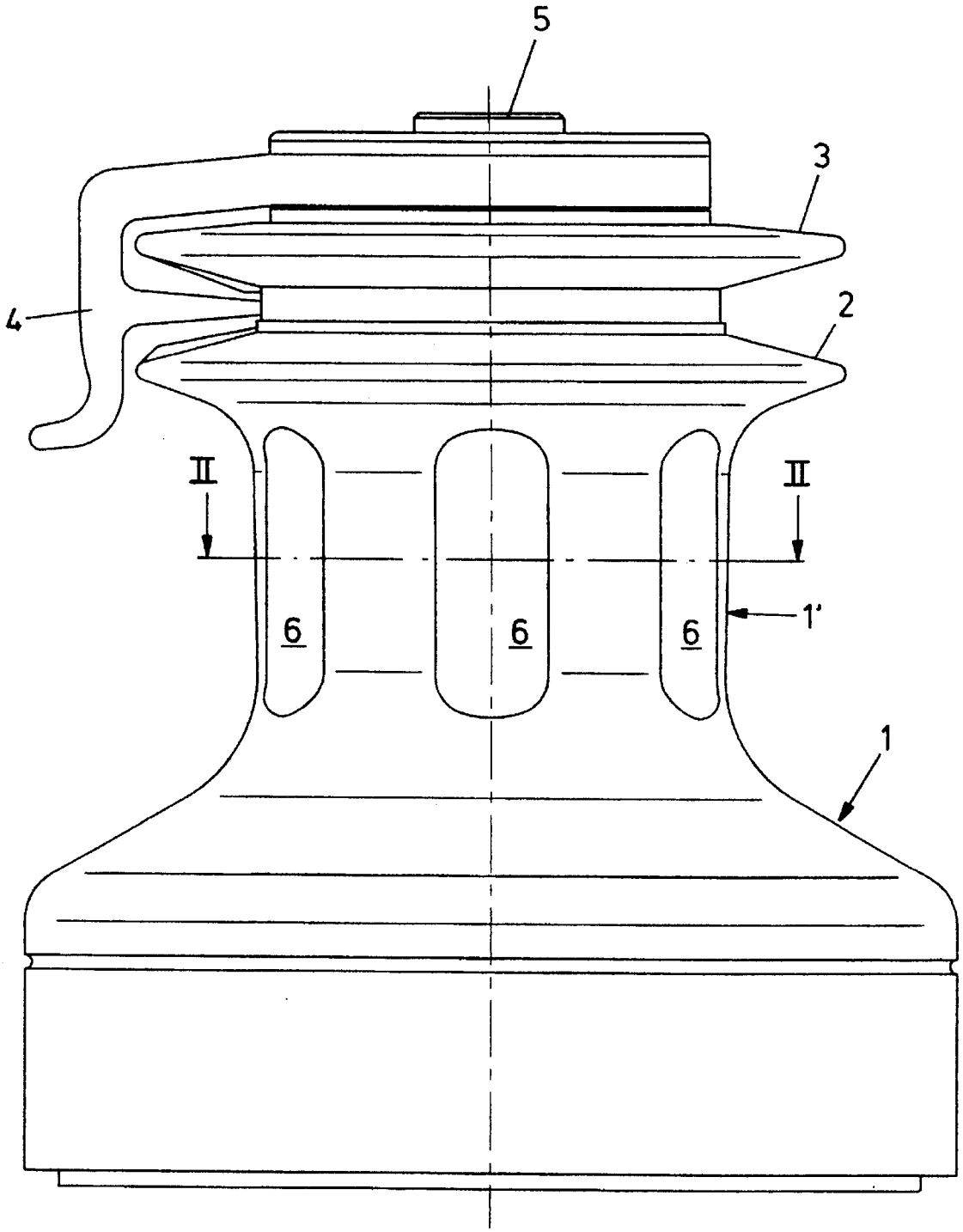
FIG. 1 is a side elevation of a winch according to the invention.

In all figures, identical parts have been designated by identical reference numerals.

FIG. 1 is a side elevation of a self-tailing winch of the type disclosed in Dutch patent application 8202198. Although the invention is explained with reference to a drawing of a winch of the self-tailing type, the invention is not limited to this, but is applicable to any type of winch. The winch according to FIG. 1 comprises a housing 1 whose diameter at the bottom thereof is greater than in the central portion 1'; a flange 2 mounted at the top of the housing, which flange becomes thinner toward the circumference and may form one whole with the housing, having a diameter greater than that of the central portion 1' of the housing; an annular plate 3 mounted on the top side of the flange and becoming thinner toward the circumference, and a stripper arm 4, arranged at the level of the V-shaped slot formed between the flange 2 and the plate 3, which stripper arm is mounted on the top side of the plate 3. Provided at a central position relative to the housing, at the top thereof, is an opening 5 for receiving a handle for rotating the housing for winding or unwinding a sheet or line.

As the manner in which the driving gear of the housing functions and the exact construction of the V-shaped groove between the flange 2 and the plate 3 is not relevant for the present invention, these aspects will not be further explained. For a detailed description of these aspects of a self-tailing winch, reference can be made to the above-mentioned Dutch patent application and the prior art references mentioned therein.

In operation, the line or sheet which is wound or unwound by means of the winch is first wound by a number of turns around the central portion 1' of the housing and subsequently guided into the V-shaped groove between the flange 2 and the plate 3. In the known winches, the outer surface of the central portion 1' has been roughened to prevent the line or sheet from slipping over this portion, which is most undesirable for a proper functioning of the winch. This rough surface, having a roughness of, for instance, 100–150 grains/$cm^2$, causes substantial wear of the line or sheet, especially in the lower portion of the housing portion 1', where the sheet or line, coming from the sail, first contacts the housing.

In accordance with the invention, the outer surface of the central portion 1' of the housing is not roughened, but configurated such that it is not circular in cross section, which is realized by providing the central portion with a plurality of faces 6 or 6', extending along this central portion in vertical direction, which faces are concave (6') or may be alternately concave (6') and flat (6). For the number of faces provided on the central portion and the shape thereof a large number of variations are possible, a number of which will be explained hereinafter. All these variations, however, have in common that along the surface of the housing part 1' unevennesses are formed sufficient to prevent the line or sheet from slipping over this central portion without causing the line or sheet to wear excessively. As the entire housing 1, which is made of metal and whose surface may be anodized or chromed, can be polished, the edges at the transition between a face 6 or 6' and the adjoining housing surface will also be polished and will hence be sufficiently flattened to realize this object. Preferably, the faces 6, 6' extend over the entire central portion 1' and over a small part of the portion of the housing where the diameter thereof increases at the bottom and top.

Figure 2A:
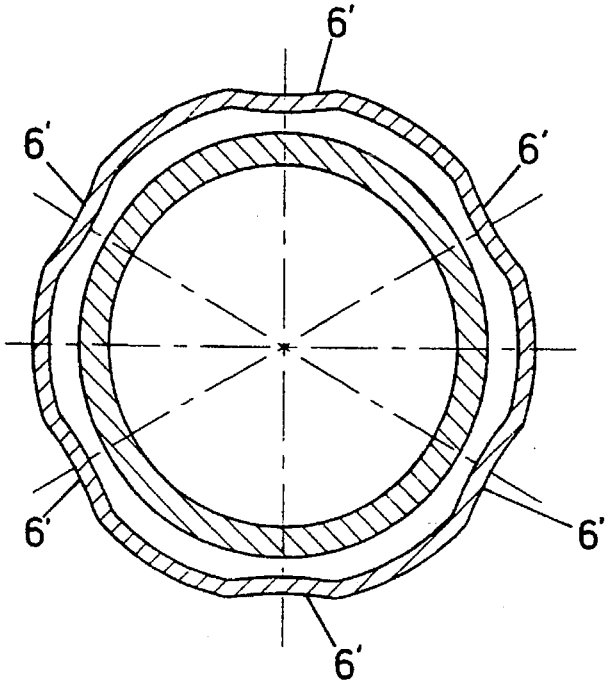
FIGS. 2*a* and 2*b* show two possible cross sections taken on the line II—II of FIG. 1.
Figure 2B:
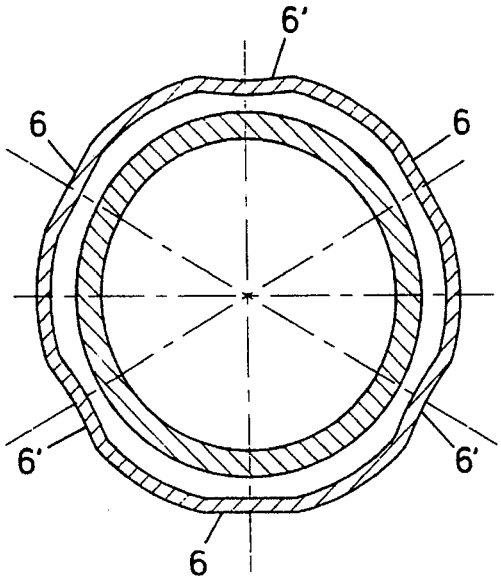

FIG. 1 shows an embodiment of the winch according to the invention having six faces 6', all of them being concave, as shown in FIG. 2*a*, or alternately flat (6) and concave (6'), as shown in FIG. 2*b*.

Figure 4A:
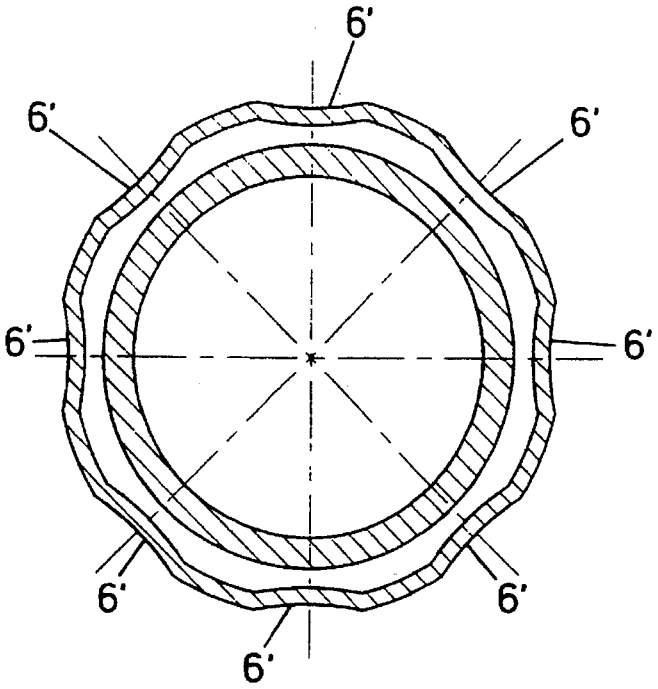
FIGS. 4*a* and 4*b* show two possible cross sections taken on the line IV—IV of FIG. 3.
Figure 3:
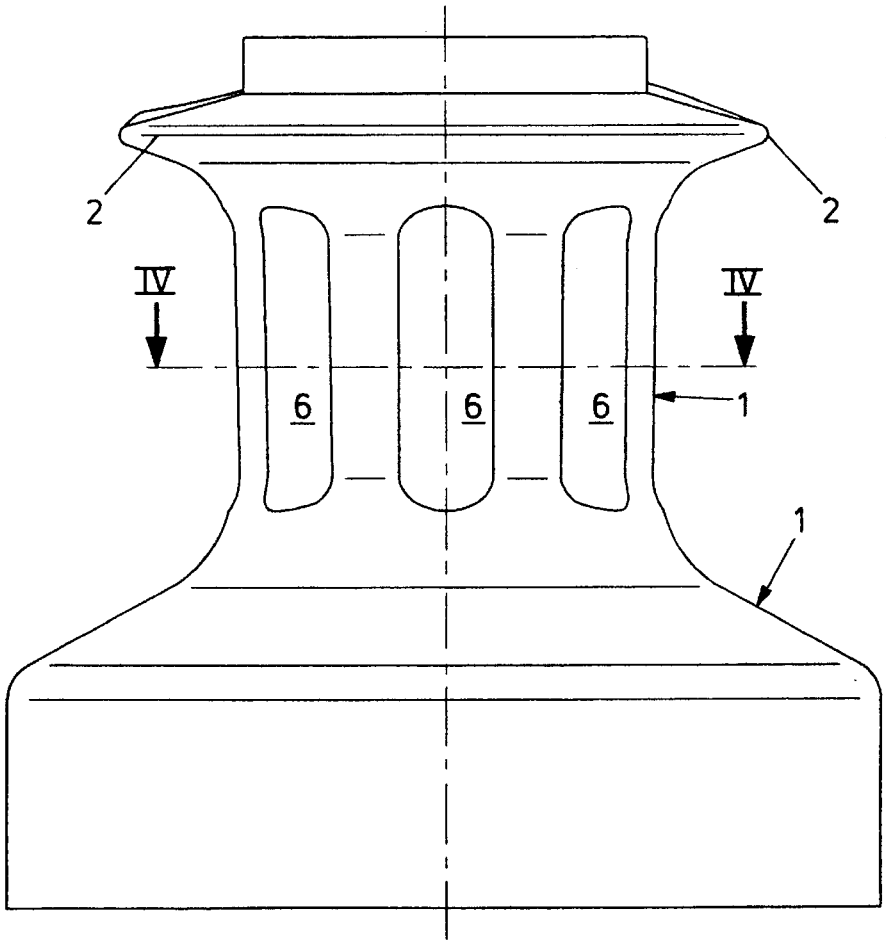
FIG. 3 is a side elevation of a second variant of the housing of the self-tailing winch according to the invention.
Figure 4B:
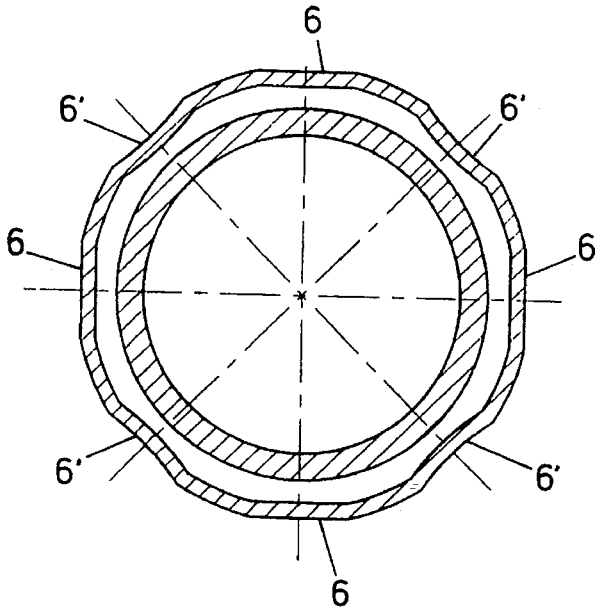

FIG. 3 only shows the housing 1 of a winch according to the invention, whose central portion is provided with eight faces; these faces have been designated by reference numeral 6 where they are flat and by reference numeral 6' where they are concave. FIG. 4 shows in cross section three possible configurations of such faces; FIG. 4*a* shows eight concave faces 6' and FIG. 4*b* shows eight faces which are alternately flat and concave.

Figure 5:
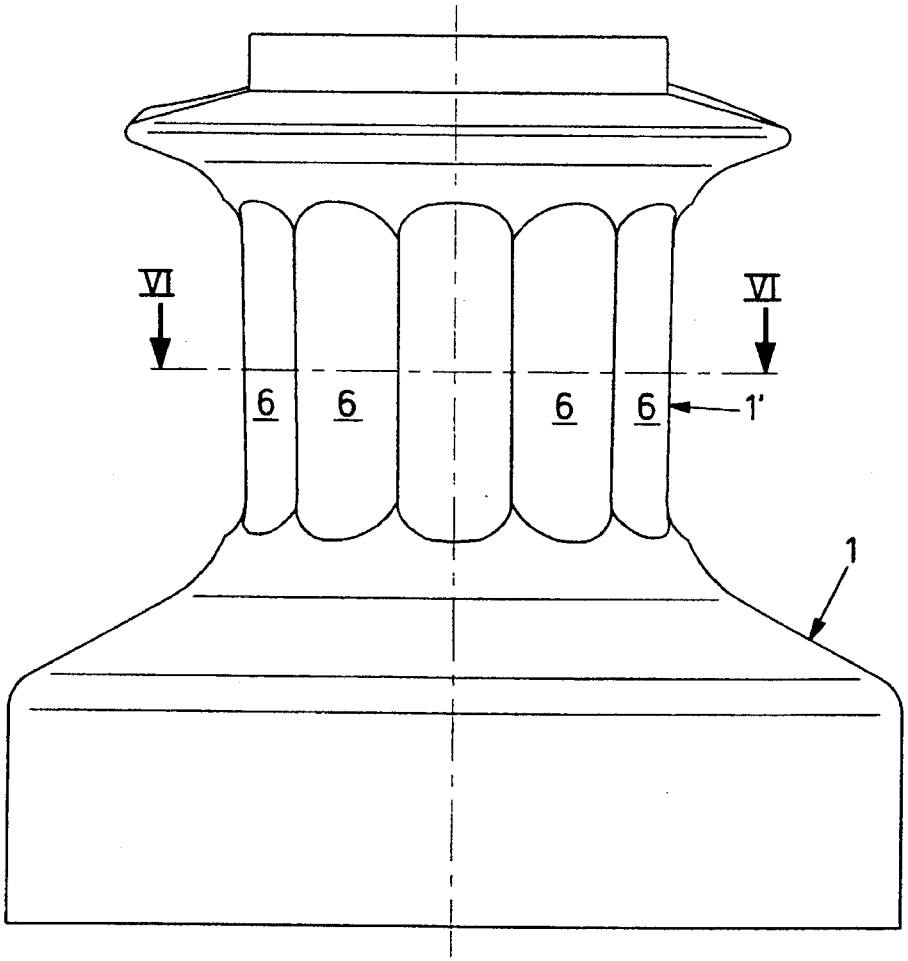
FIG. 5 is a side elevation of a third variant of the housing of the self-tailing winch according to the invention.
Figure 6A:
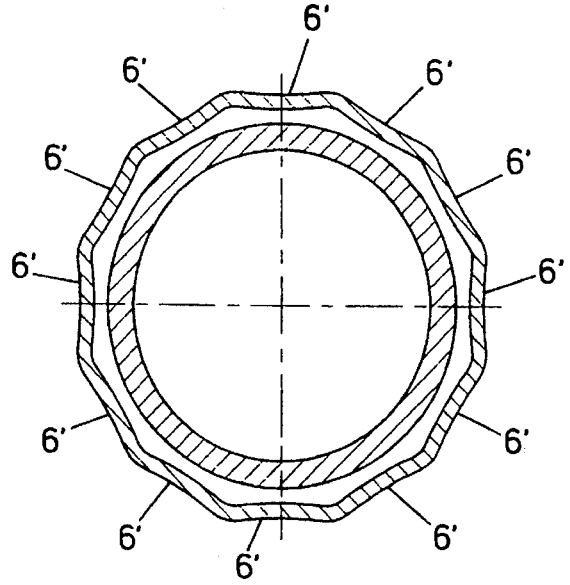
FIGS. 6*a* and 6*b* show two possible cross sections taken on the line VI—VI of FIG. 5.
Figure 6B:
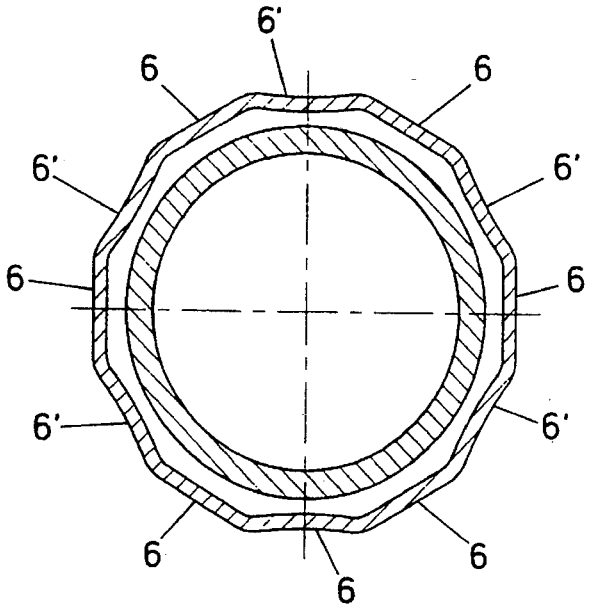

FIG. 5 shows an embodiment of the housing 1 wherein the entire surface of the housing part 1' consists of faces 6' and, optionally, faces 6, adjoining each other. Various possible cross-sectional configurations are shown in FIG. 6, wherein FIG. 6*a* shows a succession of concave faces 6' and FIG. 6*b* alternately shows a flat face 6 and a concave face 6'.

Figure 8A:
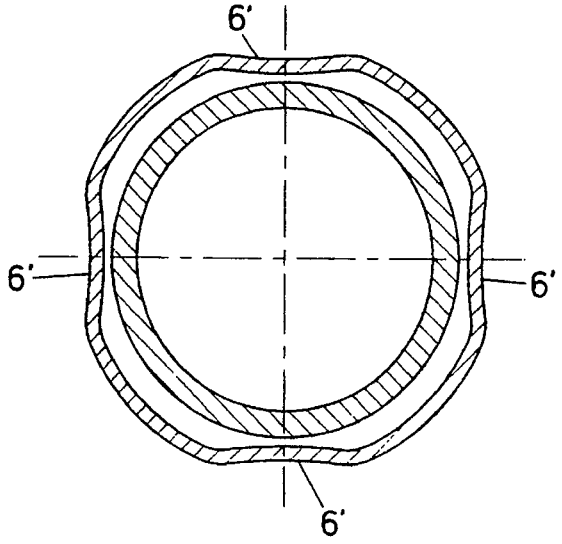
FIGS. 8*a* and 8*b* show two possible cross sections taken on the line VIII—VIII of FIG. 7.
Figure 8B:
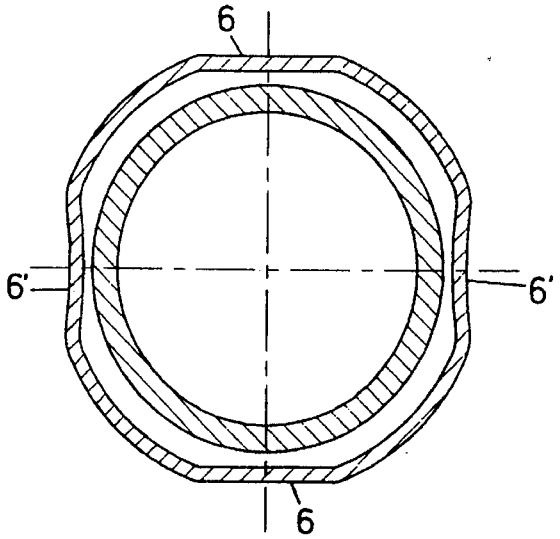
Figure 7:
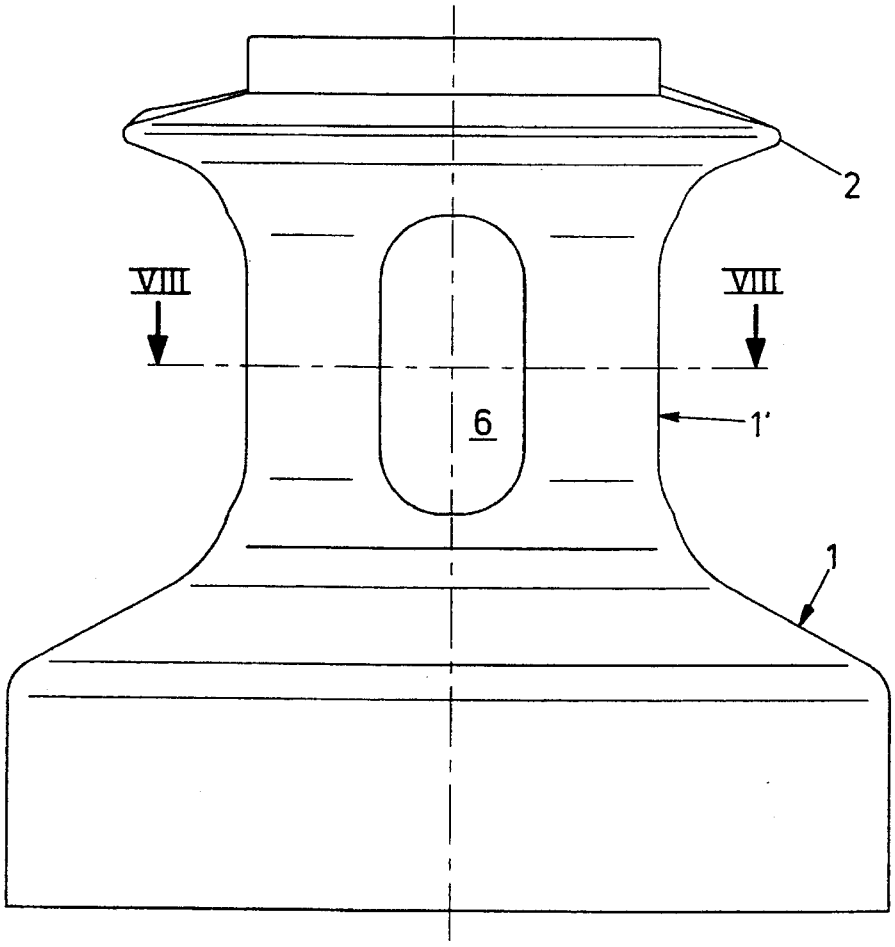
FIG. 7 is a side elevation of a third variant of the housing of the self-tailing winch according to the invention.

Finally, FIG. 7 shows an embodiment of the housing 1 having only four faces 6' and, optionally, faces 6, with FIG. 8 again showing different possible arrangements of these faces: FIG. 8*a* shows four concave faces 6' and FIG. 8*b* again alternately shows a flat (6) and a concave (6') face.

It is emphasized that the above is only a random selection from the amount of possible numbers of faces 6 or 6', that any other number greater than four can in principle be chosen, depending on the specific operating conditions under which the winch is intended to be used; that, in principle, the faces need not be evenly distributed over the surface of the housing part 1', as is the case in all examples described, and that, in the case of alternate face shapes, the alternation need not take place continuously.

I claim:

1. A winch for use on a sailing vessel, the sailing vessel having a sail and a line or sheet coming from the sail, the winch comprising:

a substantially cylindrical housing having a bottom portion, the housing rotatably disposed around a central shaft;

said housing comprising, at a top thereof, a flange and having a central portion of a diameter smaller than a diameter of the flange and smaller than a diameter of the bottom portion, the central portion holding the line or sheet coming from the sail of the vessel;

the central portion of the housing including a smooth outer surface and a plurality of faces extending over the central portion in a vertical direction, a gradual and even transition being between each of the plurality of faces and the smooth outer surface; said faces, viewed in a horizontal direction along the outer surface, being concave; and wherein said faces cause an uneven surface on the central portion to prevent the line or sheet from slipping over the central portion.

2. A winch according to claim 1, wherein a flat face is disposed between each pair of successive concave faces.

3. A winch according to claim 1, wherein cylindrical outer surface portions of the housing are disposed between two successive faces, the faces being evenly distributed over the outer surface of the housing.

4. A winch according to claim 1, wherein the faces directly adjoin each other.

5. A winch according to claim 1, wherein number of faces is eight.

6. A winch according to claim 1, wherein number of faces is six.

7. A winch according to claim 1, wherein the faces extend in vertical direction at least over an entire central portion of the housing.

8. A winch according to claim 1, wherein the faces are oblong.

* * * * *